US007416704B2

(12) United States Patent
Scordato et al.

(10) Patent No.: US 7,416,704 B2
(45) Date of Patent: Aug. 26, 2008

(54) HANDHELD PIPETTE

(75) Inventors: Richard E. Scordato, Mt. Kisco, NY (US); Lou Ann Page, Yorktown Heights, NY (US); Kevin Costello, Seacliff, NY (US); Sonya Schieffer, New York, NY (US); Gary Shigeru Natsume, Brooklyn, NY (US)

(73) Assignee: VistaLab Technologies, Inc., Pleasantville, NY (US)

( * ) Notice: Subject to any disclaimer, the term of this patent is extended or adjusted under 35 U.S.C. 154(b) by 173 days.

(21) Appl. No.: 09/873,522

(22) Filed: Jun. 4, 2001

(65) Prior Publication Data

US 2002/0012613 A1 Jan. 31, 2002

Related U.S. Application Data

(60) Provisional application No. 06/214,143, filed on Jun. 26, 2000.

(51) Int. Cl.
*B01L 3/02* (2006.01)
*B65D 5/72* (2006.01)

(52) U.S. Cl. ..... 422/100; 222/567; 222/572; 222/321.7; 222/321.8; 222/321.9

(58) Field of Classification Search ..... 422/100, 422/919, 921, 922, 923, 924, 925, 928, 931; 436/180; 73/863, 863.32, 864, 864.11, 864.13, 73/864.14, 864.16, 864.91, 864.01; D7/300, D7/313, 590; 222/165, 189.01, 465.1, 566, 222/572, 321.7, 321.8, 321.9; 169/88, 99
See application file for complete search history.

(56) References Cited

U.S. PATENT DOCUMENTS

| | | | | |
|---|---|---|---|---|
| 586,781 | A * | 7/1897 | Rawhouser | 222/341 |
| 1,923,279 | A * | 8/1933 | Sameshima | 239/333 |
| 2,066,977 | A * | 1/1937 | Iler | 222/209 |
| D104,644 | S * | 5/1937 | Thompson et al. | D7/313 |
| 2,086,348 | A * | 7/1937 | Bernhardt | 222/321.9 |

(Continued)

FOREIGN PATENT DOCUMENTS

| | | |
|---|---|---|
| EP | 0421785 | 4/1991 |

(Continued)

OTHER PUBLICATIONS

"The Automatic Pipette", American Diagnostica.

(Continued)

*Primary Examiner*—Brian R. Gordon
(74) *Attorney, Agent, or Firm*—Baker & McKenzie LLP

(57) ABSTRACT

This invention provides a hand held pipette which is ergonomically designed to reduce user fatigue and injury. The pipette preferably includes a nozzle extending downward at a selected angle from a point near the top of a base portion of the pipette, the base portion being grasped by the operator's hand, and may also include a hook extending from a second point near the top of the body portion which is angularly spaced from the first point, which hook extends over a portion of a user's hand to support the pipette thereon. The pipette is also designed to permits operation with the user's wrist and arm in a neutral position and minimizes local pressure points on the operator's hand.

22 Claims, 8 Drawing Sheets

U.S. PATENT DOCUMENTS 2,091,404 A * 8/1937 Hicks ..... 222/340
2,660,342 A * 11/1953 Ruf ..... 222/340
2,710,658 A * 6/1955 Husthsing et al. ..... 169/88
2,796,204 A * 6/1957 Math ..... 222/324
2,876,846 A * 3/1959 Howard ..... 169/77
3,039,500 A * 6/1962 Goldberg ..... 73/864.14
3,129,854 A * 4/1964 Boehm et al. ..... 222/321.9
3,134,506 A * 5/1964 Way ..... 222/83.5
3,244,009 A * 4/1966 Tiet Je et al. ..... 73/864.14
3,246,559 A * 4/1966 Clifford, Jr. ..... 356/246
3,251,420 A * 5/1966 Rodgers ..... 169/77
3,558,014 A 1/1971 Wood et al.
D221,791 S * 9/1971 Chi ..... D7/313
3,719,087 A 3/1973 Thiers
3,732,735 A 5/1973 Cohen
3,754,687 A 8/1973 Norton
3,786,683 A * 1/1974 Berman et al. ..... 73/864.14
3,853,012 A 12/1974 Scordato et al.
3,933,048 A 1/1976 Scordato
3,954,014 A 5/1976 Andrews, Jr. et al.
3,991,617 A 11/1976 Marteau d'Autry
4,151,750 A 5/1979 Suovaniemi et al.
4,164,870 A 8/1979 Scordato et al.
4,257,267 A 3/1981 Parsons
4,257,268 A * 3/1981 Pepicelli et al. ..... 73/864.15
4,263,257 A * 4/1981 Metsala ..... 422/100
4,283,950 A 8/1981 Tervamaki
4,343,418 A * 8/1982 Jurecic et al. ..... 222/386
4,369,665 A 1/1983 Citrin
4,475,666 A * 10/1984 Bilbrey et al. ..... 222/14
4,478,094 A 10/1984 Salomaa et al.
4,528,161 A * 7/1985 Eckert ..... 422/100
RE32,210 E 7/1986 d'Autry
4,598,840 A * 7/1986 Burg ..... 222/135
4,671,123 A 6/1987 Magnussen, Jr. et al.
4,690,005 A * 9/1987 Tervamaki et al. ..... 73/864.12
4,790,176 A 12/1988 d'Autry
4,815,541 A * 3/1989 Arrington ..... 169/74
4,821,586 A 4/1989 Scordato et al.
4,967,604 A 11/1990 Arpagaus et al.
4,988,481 A 1/1991 Jarvimaki et al.
5,104,624 A * 4/1992 Labriola ..... 422/100
5,104,625 A 4/1992 Kenney
5,214,968 A * 6/1993 Kenney ..... 73/864.15
5,389,341 A 2/1995 Tuunanen et al.
5,394,789 A * 3/1995 Evans et al. ..... 99/345
5,403,553 A 4/1995 Heinonen
5,505,097 A 4/1996 Suovaniemi et al.
5,509,318 A * 4/1996 Gomes ..... 73/864.11
5,611,784 A 3/1997 Barresi et al.
5,614,153 A 3/1997 Homberg
5,616,871 A 4/1997 Kenney
5,620,661 A 4/1997 Schurbrock
5,687,884 A * 11/1997 Bodin et al. ..... 222/321.7
5,747,709 A * 5/1998 Oshikubo ..... 73/864.18
5,770,159 A * 6/1998 Marteau D'Autry ..... 422/100
5,792,424 A * 8/1998 Homberg et al. ..... 422/100
5,807,524 A 9/1998 Kelly et al.
5,924,603 A * 7/1999 Santagiuliana ..... 222/321.1
5,970,806 A 10/1999 Telimaa et al.
6,090,348 A 7/2000 Steele et al.
6,105,819 A * 8/2000 Ho et al. ..... 222/78
6,197,259 B1 3/2001 Kelly et al.
6,240,791 B1 * 6/2001 Kenney ..... 73/864.14
6,299,841 B1 10/2001 Rainin et al.
6,324,925 B1 12/2001 Suovaniemi et al.
6,365,110 B1 4/2002 Rainin et al.
6,428,750 B1 8/2002 Rainin et al.
6,524,531 B1 * 2/2003 Feygin ..... 422/100
6,532,837 B1 3/2003 Magussen, Jr. et al.
6,540,964 B2 * 4/2003 Kohrmann et al. ..... 422/100
6,737,023 B1 * 5/2004 Kelly et al. ..... 422/100
6,861,034 B1 3/2005 Elrod et al.
2001/0019701 A1 9/2001 Braun et al.
2001/0035429 A1 * 11/2001 Colquhoun ..... 222/93
2002/0001545 A1 * 1/2002 Cronenberg et al. ..... 422/100
2002/0020233 A1 * 2/2002 Baba et al. ..... 73/864.16
2003/0074989 A1 4/2003 Magnussen et al.
2003/0082078 A1 5/2003 Rainin et al.
2003/0099578 A1 5/2003 Cote et al.
2004/0208795 A1 10/2004 Toi et al.

FOREIGN PATENT DOCUMENTS

EP 0437906 7/1991
GB 2172218 9/1986
WO WO 01/57490 A1 8/2001

OTHER PUBLICATIONS

Handi-Pet Pipetting Gun, General Diagnostics, 1973.
Eppendorf EDOS 5221, Instruction Manual, Eppendorf, Germany.

* cited by examiner

HANDHELD PIPETTE

RELATED APPLICATIONS

This Application claims priority from provisional application Ser. No. 06/214,143, filed Jun. 26, 2000.

FIELD OF THE INVENTION

This invention relates to handheld pipettes, and more particularly to an improved, more ergonomic such pipette.

BACKGROUND

Handheld pipettes are utilized to aspirate one or more fluids from a first receptacle containing such fluids, generally a precise quantity of such fluid, and to dispense the fluid to a second receptacle where the fluid may be analyzed or otherwise tested. To prevent interaction between successive samples, while minimizing cleaning/sterilization requirements, disposable tips are typically mounted to the pipette nozzles. Since an operator using such a pipette may do hundreds of aspirations/dispensings in a single day, repetitive stress injuries are a common problem for such operators. Many complain of wrist and shoulder injuries caused by extended periods of pipetting using traditional axial pipette designs and forearm strain is also a common complaint.

One reason for these injuries is that the operator needs to tightly grip the generally cylindrical pipette, particularly when mounting or removing a tip therefrom, but also while performing aspirating and dispensing operations, the gripping force required being somewhat less, but still significant, during performance of the latter operations. Another potential source of injury is the fact that, for most operations, the user's wrist/hand must be rotated while performing the operation rather than being held in its natural or neutral position which is generally approximately 45° to both the horizontal and vertical. It is preferable that as much of the pipetting operation as possible be performed with the wrist/hand in the neutral position. Similarly, to avoid such stress injuries, it is desirable that the elbow and shoulder joints also be in their neutral posture or position at approximately the mid-point of their travel path. Stress is generally minimized for a given operation when the operation is performed with each joint in this position.

Another problem with existing designs is that, with the tip being an extension of the cylindrical pipette, the pipette is relatively long, making it difficult to maneuver and use under a laboratory fume hood and forcing the operator to hold the pipette above the receptacle being aspirated from or dispensed into. This places stress on the muscles and joints of the shoulder, which, over time, results in fatigue and can ultimately lead to injury. The position of the nozzle and tip away from the operator's fingers also reduces the operator's "feel" of the tip and make it more difficult for the operator to control the tip, adding further to the fatigue and strain of performing pipetting operations.

Another ergonomic problem for pipettes is that operator discomfort and injury can result from points on a pipette which cause high contact pressure on the operator's fingers, thumb or other portions of the operator's hand. This can result from buttons or keys on the pipette having local pressure points or from such points on the body of the pipette which is gripped by the operator. To avoid discomfort or injury, there should be no point on the pipette where more than 14 psi pressure is exerted on the operator's hand. Few, if any, existing pipettes satisfy this criteria.

It is also desirable, particularly when aspirating fluid, to be able to see the tip of the pipette during the operation so that the tip is immersed only to the extent necessary to aspirate the fluid. Deeper immersion can result in inaccurate aspiration of the fluid and can cause other potential problems.

A need therefore exists for an improved, more ergonomic, pipette design which requires less gripping force, and preferably little if any gripping force by the operator on the pipette both during the mounting and ejection of tips from the pipette nozzle and during the aspiration and dispensing of fluids using the pipette. Such design should also facilitate the user's joints, including elbow, shoulder and wrist/hand being held in their neutral or natural position during pipetting operations, facilitate easier access to laboratory fume hoods, position the pipette nozzle and tip close to the operator's fingers, and in particular, to the operator's forefinger, to provide optimum control of the tip and position the nozzle and tip so the tip can be viewed by the operator at least when aspirating fluid and so the operator's elbow or other part of the operator's arm may rest on the surface containing the receptacle on which the pipetting operation is being performed, thereby reducing strain on the operator's shoulder, and minimize contact pressure on all parts of the operator's hand. Since substantial differences exist in the size, and to a lesser extent shape, of operator hands and arms, it would also be desirable if various aspects of the pipette could be customized, for example by use of adjustable or replaceable components, and/or by use of adapters, so as to be able to optimize the ergonomics of the pipette for a given user. Finally, it is sometimes desirable to lay a pipette down in the middle of a pipetting operation to, for example, open the lid of the fluid source, move test tubes, push a button on a machine, adjust the opening of a fume hood to permit access thereto, to otherwise provide access to the fluid source or sink, etc. It should be possible to accomplish this function without leakage of fluid either into or from the pipette and without contamination of the tip. It should also be possible to quickly and easily grasp the pipette in proper position for usage, preferably by use of only one hand. These later objectives can in at least some cases best be achieved if the pipette can be in a "stand-up" position when not in use. While some existing pipettes provide a limited number of these capabilities, a pipette design providing all, or at least most, of these capabilities does not currently exist.

SUMMARY OF THE INVENTION

In accordance with the above, this invention provides a handheld pipette which includes a body portion shaped to fit in an operator's hand and a nozzle portion extending from a point on the body portion, which point is preferable on an upper section of the body portion, and at a downward facing angle θ of approximately 60° to 80° to the central axis of the body, the angle θ being approximately 70° to the central axis for a preferred embodiment. The nozzle angle θ may also be made adjustable and may be such as to permit the operator's wrist, elbow, and/or shoulder to be in a substantially neutral position when the pipette is performing a pipetting operation. It is also desirable that the user be able to clearly see the pipette tip during pipetting operations. The nozzle is preferably designed to have a tip mounted to the end thereof, the angle of the nozzle being such that any tip mounting force is in a direction causing a major component of the force to be applied against or substantially perpendicular to a portion of the operator's hand grasping the body portion which is substantially between the second joint of the operator's fingers and a point slightly behind the operator's knuckles.

A hook may extend from a point on the body portion, which point is preferably on an upper section of the body portion, and which point is sufficiently angularly spaced from the point from which the nozzle extends to permit the hook to fit over a selected portion of the operator's hand when the pipette is being held by the operator in a position for use. The hook may be adjustable to change the angle by which the hook is spaced from the nozzle, the height on the body portion for the point from which the hook extends and/or the angle of the hook relative to the central axis of the body portion. The hook may also be removably mounted to the body portion and may be replaceable with a hook of different size/shape to accommodate different hand sizes.

At least one button may be provided on the body which is operable to effect aspiration/dispensing of fluid through the nozzle, the button extending from the top of the body to be operated by an operator's thumb for one embodiment of the invention and being mounted on the body portion to be squeezed by an operator's hand or forefinger for other embodiments. The direction in which the button is operated is preferably at a selected angle to the nozzle. The pipette may also include a button on the body which controls ejection of a tip from the nozzle. Each of these buttons is preferably ergonomically shaped to minimize contact pressure on the operator's hand when the button is operated.

The position and angle of the nozzle are preferably such that an end of the nozzle adjacent the body portion is closely adjacent the index finger of the operator when properly held. The pipette also preferably includes a stable base permitting the pipette to stand upright on a surface, the pipette parameters, including at least the angle θ of the nozzle to an axis of the body portion and a length of tip affixed to the nozzle are selected such that the tip does not touch the surface on which it is standing. The bottom of the body portion may also be removable, at least in part, to provide access to the internals of the pipette.

An adapter may be provided which is selectively mountable to the body portion, the adapter adjusting the size of the body portion to better fit operator hand size. Padding may also be provided on at least a portion of the body portion. Portions of the pipette which come in contact with the operator's hand are preferably ergonomically designed to minimize contact pressure for the operator's hand during operation of the pipette, such contact pressure preferably not exceeding 14 psi.

In accordance with another aspect of the invention, a handheld pipette is provided which includes a body portion shaped to fit in a operator's hand, a nozzle portion extending from a first point on an upper section of the body portion and a hook extending from a second point on the upper section of the body portion, the second point being angularly spaced by an angle ϕ from the first point. The hook may be adjustable to change the angle of spacing between the nozzle and hook, the height on the body portion for the point from which the hook extends and/or the angle of the hook relative to the central axis of the body. The hook may alternatively be removably mounted and replaceable with a hook of different size and/or shape. An adapter may also be attachable to the hook.

In accordance with still another aspect of the invention, a handheld pipette is provided which includes a body portion shaped to fit in an operator's hand and a nozzle portion extending from a point on said body portion and at a downward facing angle θ to a central axis of said body portion, the body portion being shaped and the nozzle portion being positioned such that when the pipette is held in an operating position, (a) the nozzle portion is at an angle substantially perpendicular to the operator's forearm and/or (b) any force applied to mount a tip to the nozzle is in a direction causing a major component of the force to be applied against and substantially perpendicular to a portion of the operator's hand grasping the body portion which is substantially between a second joint of the operator's fingers and a point slightly behind the operator's knuckles.

The foregoing and other objects, features and advantages of the invention will be apparent from the following, more particular description of a preferred embodiment of the invention as illustrated in the accompanying drawings.

IN THE DRAWINGS

FIGS. 1A, B and C are a side, top, and front view, respectively of a handheld pipette constructed in accordance with the teachings of this invention.

DETAILED DESCRIPTION

Figure 1A:
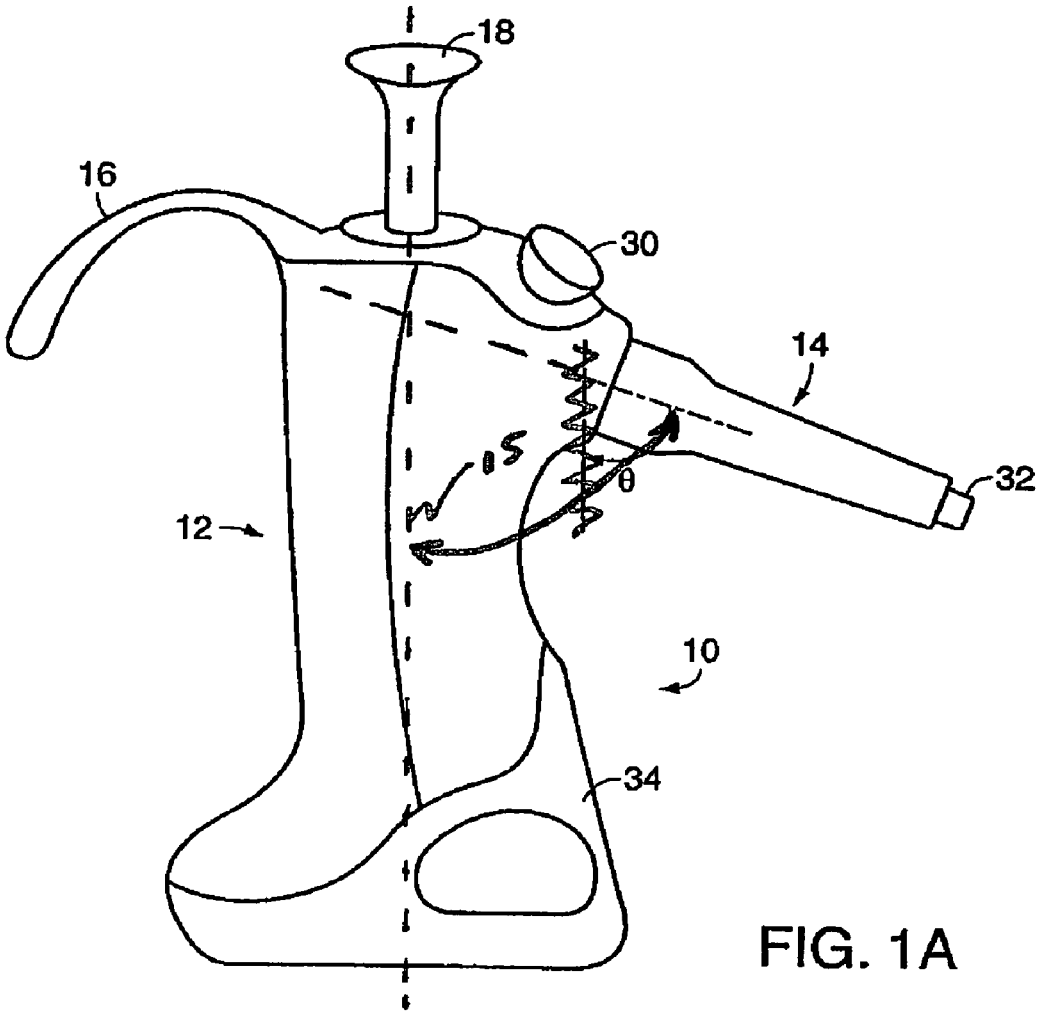
FIG. 1D is a rear view of the pipette with the rear cover removed.
Figure 1B:
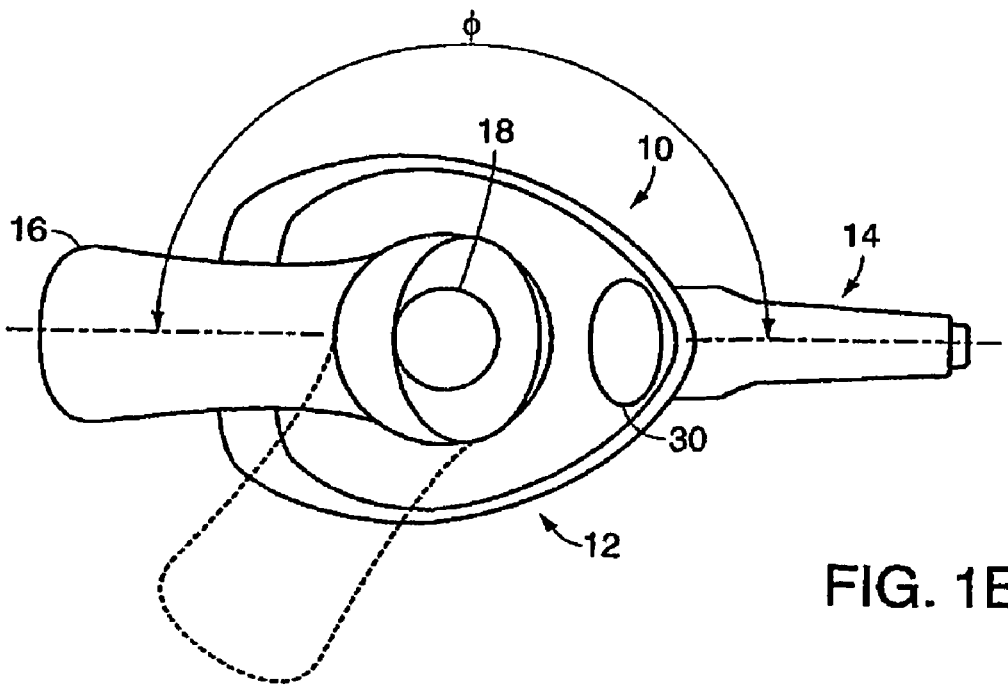
Figure 1C:
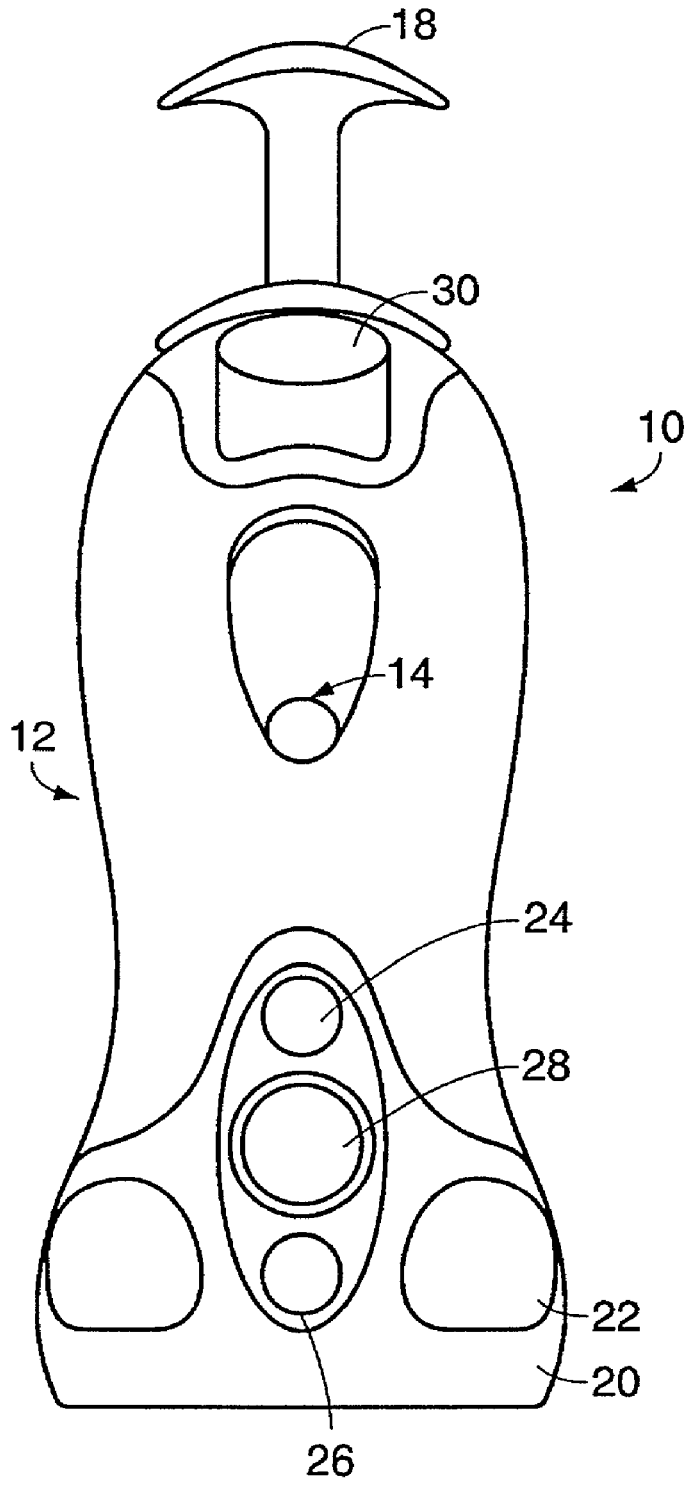
Figure 2:
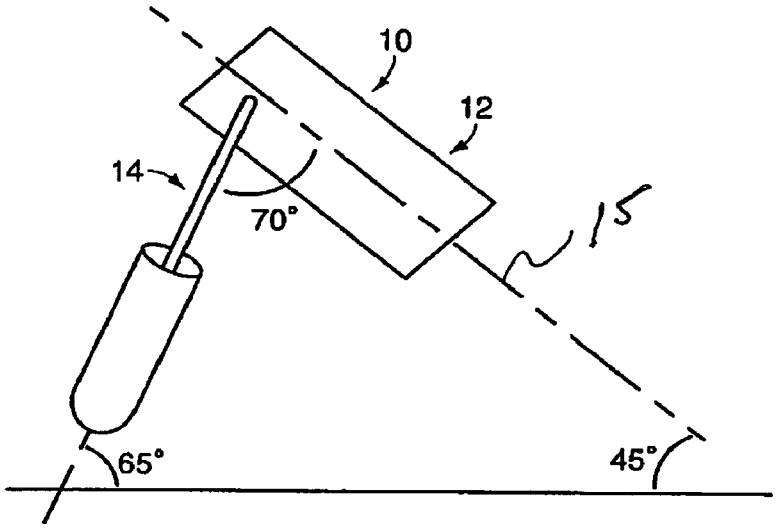
FIG. 2 is a diagrammatic view of the pipette of FIGS. 1A-1D in use, illustrating relative angles.
Figure 7A:
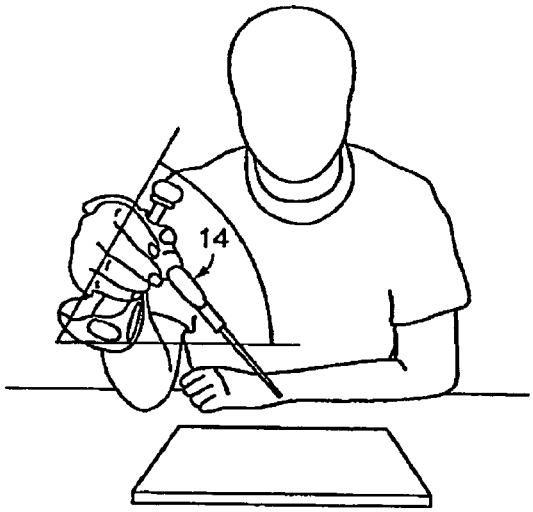
FIGS. 7A and 7B are views corresponding to FIGS. 6A and 6B illustrating an operator holding the pipette of FIGS. 1A-1D.

Referring to FIGS. 1A-1C, it is seen that the pipette 10 of this invention includes a body portion 12 and a nozzle portion 14. Nozzle portion 14 extends from a point near the top of body portion 12 and is at an angle θ to the center line 15 of the body portion. The angle θ is roughly the angle required for the nozzle portion 14 to be at a good working angle as shown in FIGS. 2, and 7 (i.e. roughly 35° from vertical), when the wrist, elbow and shoulder of an operator are all in substantially the neutral position previously discussed. This angle θ is typically approximately 60° to 80°, the angle θ being approximately 70° for an illustrative embodiment of the invention.

Figure 6A:
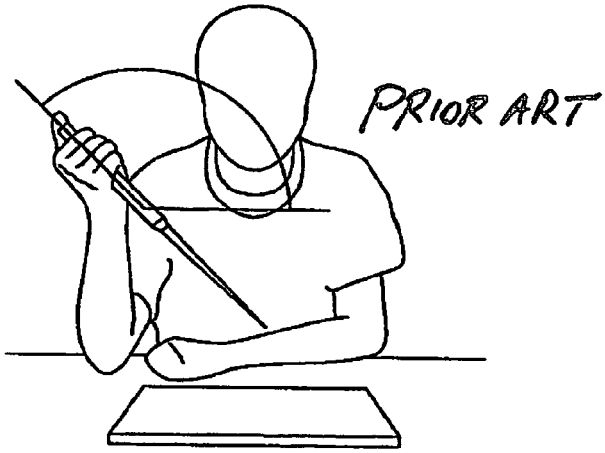
FIGS. 6A and 6B are a front and front-side view respectively illustrating an operator holding a conventional pipette for use.
Figure 6B:
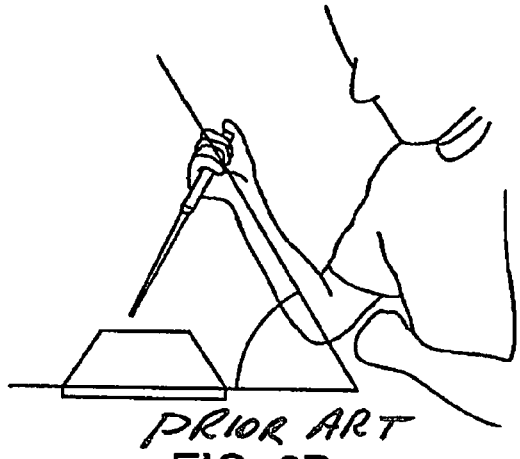
Figure 7B:
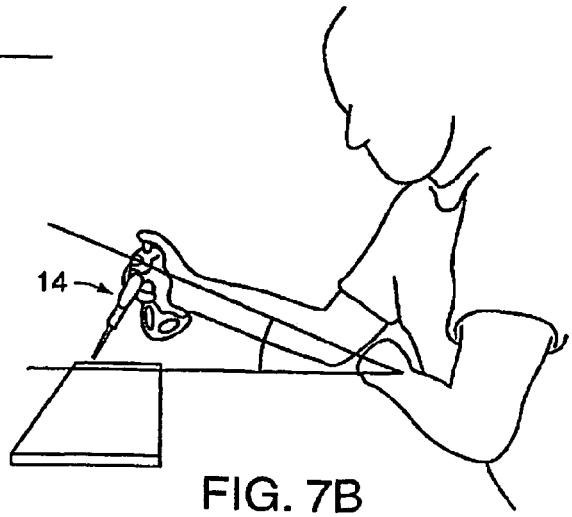

The neutral position for the wrist is approximately 45° and ergonomists recommend not rotating the wrist more than plus or minus 45° from the neutral. While as seen in FIG. 6A, the wrist angle for a standard axial pipette is approximately 135°, as is seen from FIGS. 2 and 7A, the wrist angle for the pipette of this invention is approximately the ideal 45° neutral angle. As can also be seen from these figures, when the pipette is held in this way, the user has a clear vision of the pipette tip when pipetting in general, and when aspirating from a tube or other container, as shown in FIG. 2 in particular. Further, it can be seen from FIG. 6B that for the prior art axial design, the user's arm and shoulder must be raised from the neutral position in order to pipette. However, as shown in FIG. 7B, with the pipette of this invention, these angles are reduced, permitting the user's arm and shoulder to be in substantially their neutral mid-position. FIG. 2 illustrates that the preferred 70° angle of the nozzle is ideal when the container being aspirated from is held at a natural angle of approximately 35° to the vertical (65° to the horizontal), this permitting the wrist to be at the desired 45° angle.

Figure 1D:
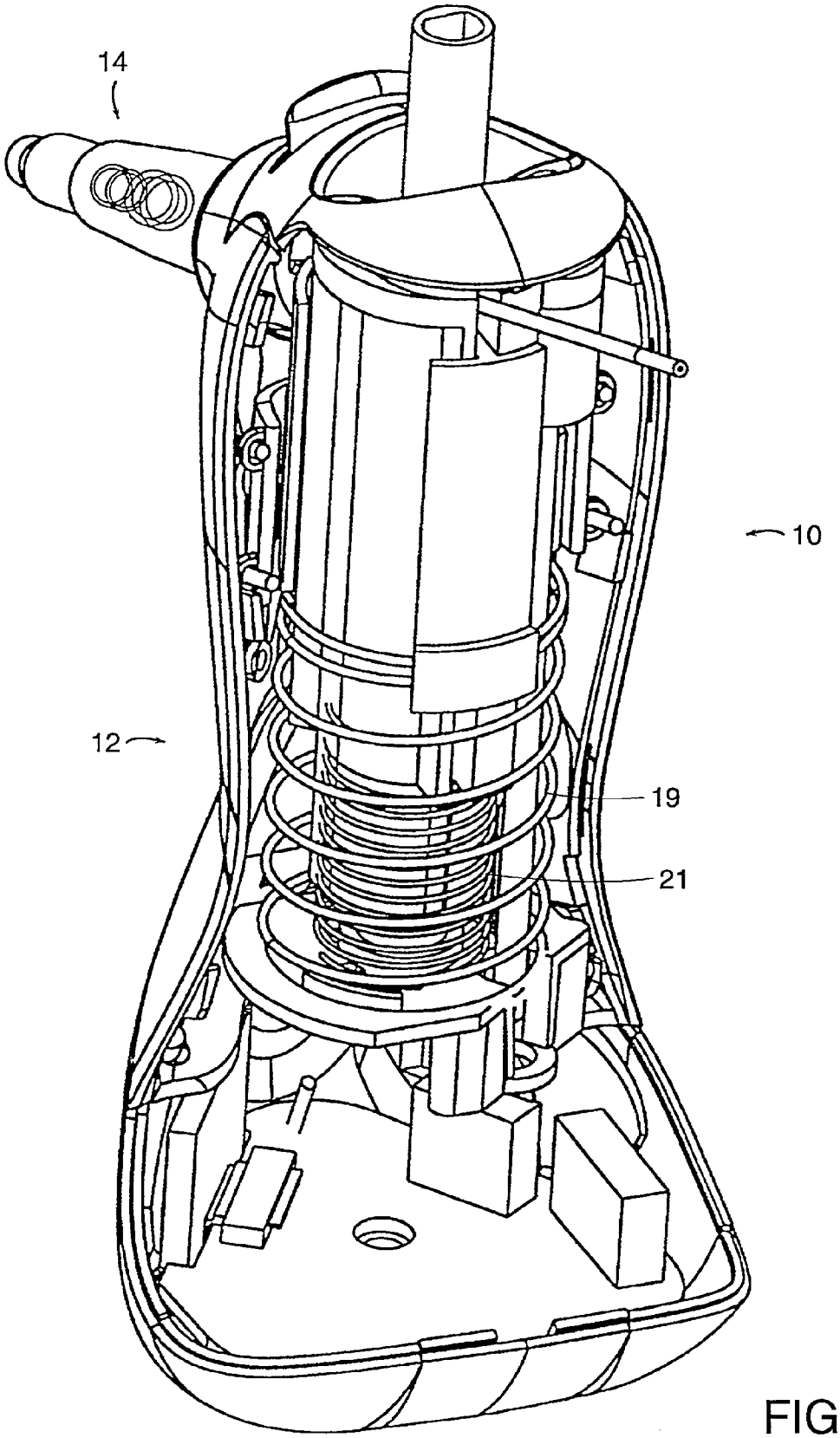

A hook 16 extends from the top of body 12 at a point which, for the illustrative embodiment shown in the figures, is spaced around the periphery of body 12 by an angle ϕ (FIG. 1B) to nozzle portion 14 which may be fixed, for example approximately 180° as shown, but, as will be discussed later, is preferably variable, for example from 150° to 210°, to accommodate variations in user preferences and in size and shape of a user's hand, an alternate position for the hook being shown in dotted lines in FIG. 1B. A thumb-operated plunger 18 extends from the top of body 12. Operation of plunger 18 pushes a piston inside body 12 into a corresponding cylinder until the piston reaches the end of the cylinder. Plunger 18 is spring loaded, for example by a spring 19 and overblow spring 21 (FIG. 1D) or otherwise biased so as to return to its raised position when pressure is not applied thereto by the operator's thumb, causing the piston to be moved back in its cylinder until the piston reaches a stop position, the stop determining the stroke of the piston and thus the volume of fluid aspirated during an aspiration operation. The stroke of piston 18 is preferable also at an angle to nozzle portion 12, this angle also being θ for the illustrative embodiment; however this angle can vary significantly with embodiment.

Referring to FIG. 1C, an interface panel 20 is provided on the lower front of body 12 which panel includes at least one LCD display 22 or other suitable display indicating, for example, the current volume setting of the piston stop and other appropriate information. A plurality of control buttons may also be provided, three such buttons being shown in the figure. These buttons may, for example, be an UP button 24, a DOWN button 26 and LOCK or ENTER button 28. The manner in which these buttons may be utilized to control stop settings will be briefly described later and are described in greater detail in application Ser. No. 09/873,521 entitled IMPROVED HAND-HELD PIPETTE filed concurrently herewith, issued as U.S. Pat. No. 6,601,433 to Kriz et al., the contents of which are incorporated herein by reference.

A second thumb-operated button 30 also extends from the top of body 12. Button 30, when pushed, releases an ejector component of nozzle portion 12 to eject a tip mounted to nozzle 32, for example in the manner described in application Ser. No. 09/873,842 entitled AUTOMATIC PIPETTE IDENTIFICATION AND DETIPPING also filed concurrently herewith, issued as U.S. Pat. No. 6,749,812 to Cronenber et al., the subject matter of this application also being incorporated herein by reference.

Thumb-operated plunger 18 and button 30 are large enough and smooth enough so that contact pressure on the operator's thumb when these are operated is minimized, and in particular is substantially less than 14 psi at all points of contact. Similarly, body 12 is ergonomically designed to distribute pressure applied to the operator's hand during all operations, including tip attachment and removal, so as to similarly minimize contact pressure.

Figure 3:
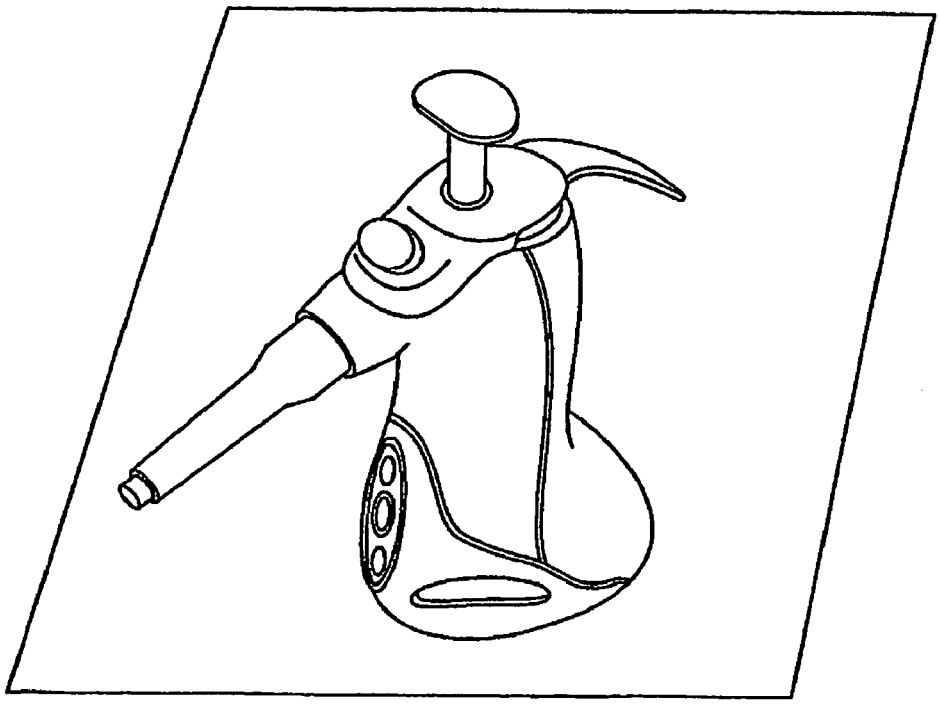
FIG. 3 is a photograph illustrating the use of the pipette of FIGS. 1A-1C.
Figure 8A:
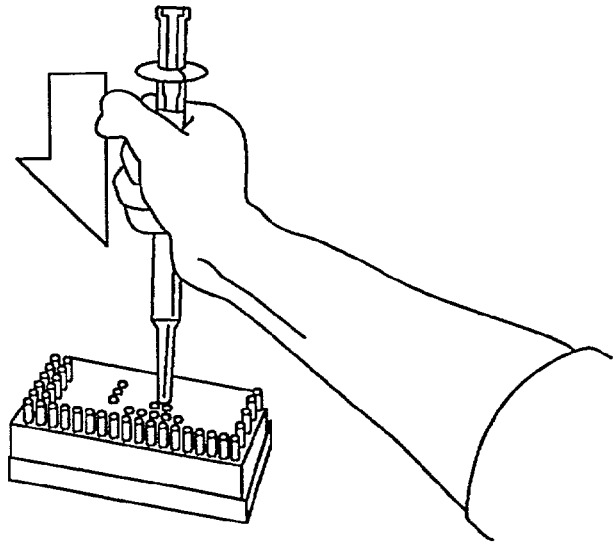
FIGS. 8A and 8B are illustrations of an operator installing a tip on the pipette for a conventional pipette and for the pipette of FIGS. 1A-1D respectively.
Figure 8B:
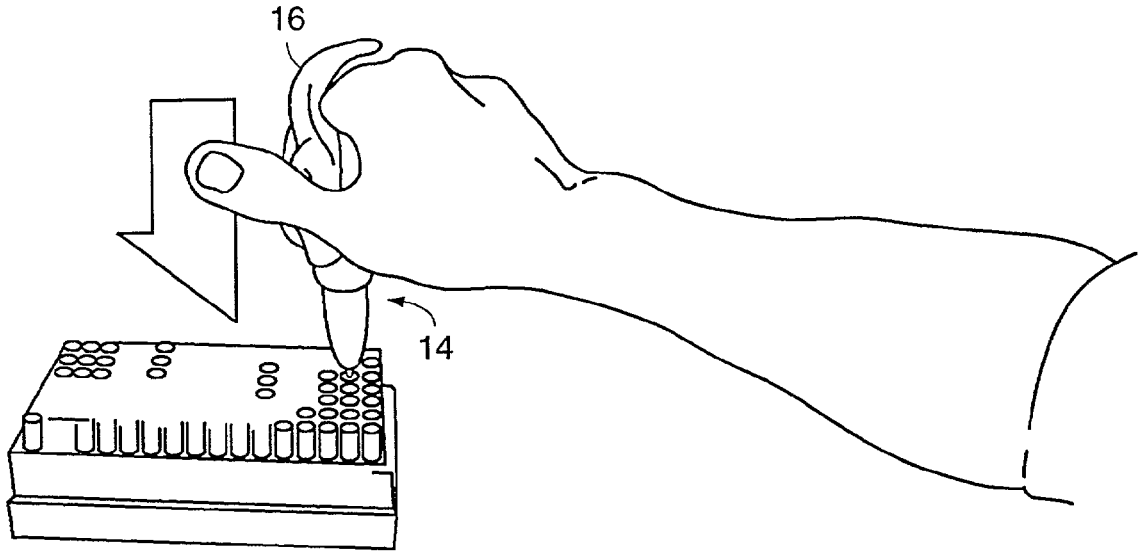

In operation, body 12 has a shape which, as may be seen in FIGS. 3, 7 and 8B permits a user's hand to wrap around the rear portion of the body with nozzle portion 14 extending adjacent to the operator's fingers, and in particular, adjacent the operator's index finger. Hook 16 preferably extends over the third joint of the user's index finger or a portion of the user's hand directly adjacent thereto and permits pipette 10 to be supported in the user's hand with little or no gripping force being applied to body 12 by the operator. To the extent the angle 4 does not result in the hook being positioned as indicated above, angle ϕ is preferably adjustable to permit the hook to be properly positioned. Since most of the force of a tip being mounted to nozzle 32 is in the direction of the center line of the nozzle, the major component of this force is, as shown in FIG. 8B, directed against the palm of the operator's hand, and in particular against and substantially perpendicular to a portion of the operator's hand which is substantially between the second joint of the operators hand (preferably the first joint) and a point slightly behind (ie on the thumb side of) the operator's knuckles, meaning that little if any gripping force on body 12 by the operator is required in order to support the pipette against this mounting force or to prevent movement of the pipette against this force. This contrasts starkly with existing pipettes where the user is grasping the barrel of the pipette and the tip mounting force is directed along the axis of this barrel, meaning that the user must tightly grip the barrel to prevent movement of the pipette away from the direction of the applied mounting force (see FIG. 8A). This tight gripping force, which is normally required between each sample for which the pipette is used, is one of the major contributing factors to operator fatigue and stress injury. The tight gripping force also increases pressure at all points of contact with the operator's hand. Thus, the reduced gripping force required when using the pipette of this invention, coupled with the ergonomic design to more evenly distribute pressure, combine to provide a pipette with minimized contact pressure in operation. These beneficial effects are further enhanced by the design being such that, when the pipette is properly held, the nozzle is, as best seen in FIG. 7B, at an angle substantially perpendicular to the operator's forearm.

Nozzle portion 14 being near the top of pipette 10, rather than extending from the bottom thereof as in the prior art, is also advantageous for several reasons. First, it significantly reduces the height of the pipette, making it easier for the pipette to be utilized in tight quarters, for example inside a laboratory fume hood. It also brings the nozzle closely adjacent the fingers, and particularly the index finger, of the operator's hand, providing the operator with far better feel and control of nozzle position for maneuvering the nozzle to a pipetting target, particularly where such movement must be made through tight quarters. As may be seen in FIGS. 3 and 7B, the nozzle being mounted near the top of the pipette rather than extending from the bottom thereof, also permits the operator's elbow, or possibly even most of the operator's forearm to rest on an adjacent surface which, where the pipette is not being held as shown in FIG. 2, could be the surface containing the receptacle involved in a pipetting operation, thereby reducing strain on the operator's shoulders, and in particular, the operator's shoulder muscles, thus reducing, and substantially eliminating, fatigue and injuries in this area as a result of repetitive pipetting operations. Finally, the nozzle portion 14 extending at the indicated angle θ results in operators being able to hold body 12 in their palm with, as previously discussed, their wrist/hand at its natural or neutral angle, and with other joints such as elbow and shoulder also in a substantially neutral position, while still having nozzle 32 at a natural angle for the pipetting operation.

Pipette base 12 also has stable bottom or base portion which permits the pipette to stand upright on a work surface (as shown for example in FIG. 3). This allows a disposable tip to remain in place when the pipette is not in use and any liquid in the disposable tip is prevented from moving back into body 12 and the piston therein because of the downward angle θ of the nozzle. The various pipette parameters, including the angle θ and the length of the tip (not shown), are selected such that the tip will not contact a surface where the pipette is set down. This contrasts with standard pipette designs with the nozzle extending from the bottom of a pipette barrel where fluid can flow back into the pipette body from the nozzle tip when the pipette is laid down on its side.

One potential problem in designing an ergonomic pipette is that there are significant differences in the sizes and shapes of people's hands, so that a pipette designed, for example for a "average" hand, might not be ergonomically ideal for most operators using the pipette who have hands bigger or smaller than the average and/or shaped slightly different from the average. There are a number of ways in which this problem may be dealt with. One way is to simply provide a number of different models, each optimized for a different hand size. This, however, increases cost of manufacture and can result in inventory mismatch problems. Further, even with two or three different models, a given operator may have trouble finding a model matching their ergonomic preferences/requirements.

Another option is to make the pipette configurable in the field to meet the ergonomic requirements of each user. Thus, for example, nozzle portion 14 might be hingingly-mounted to body portion 12, the hinge being stiff enough so as to maintain a given angle θ unless the angle is manually changed within a selected range, for example plus or minus 10°. The hinge could also be of a type having a set screw or other adjustment permitting the nozzle assembly to be moved to a desired angle and then locked in place.

Figure 4:
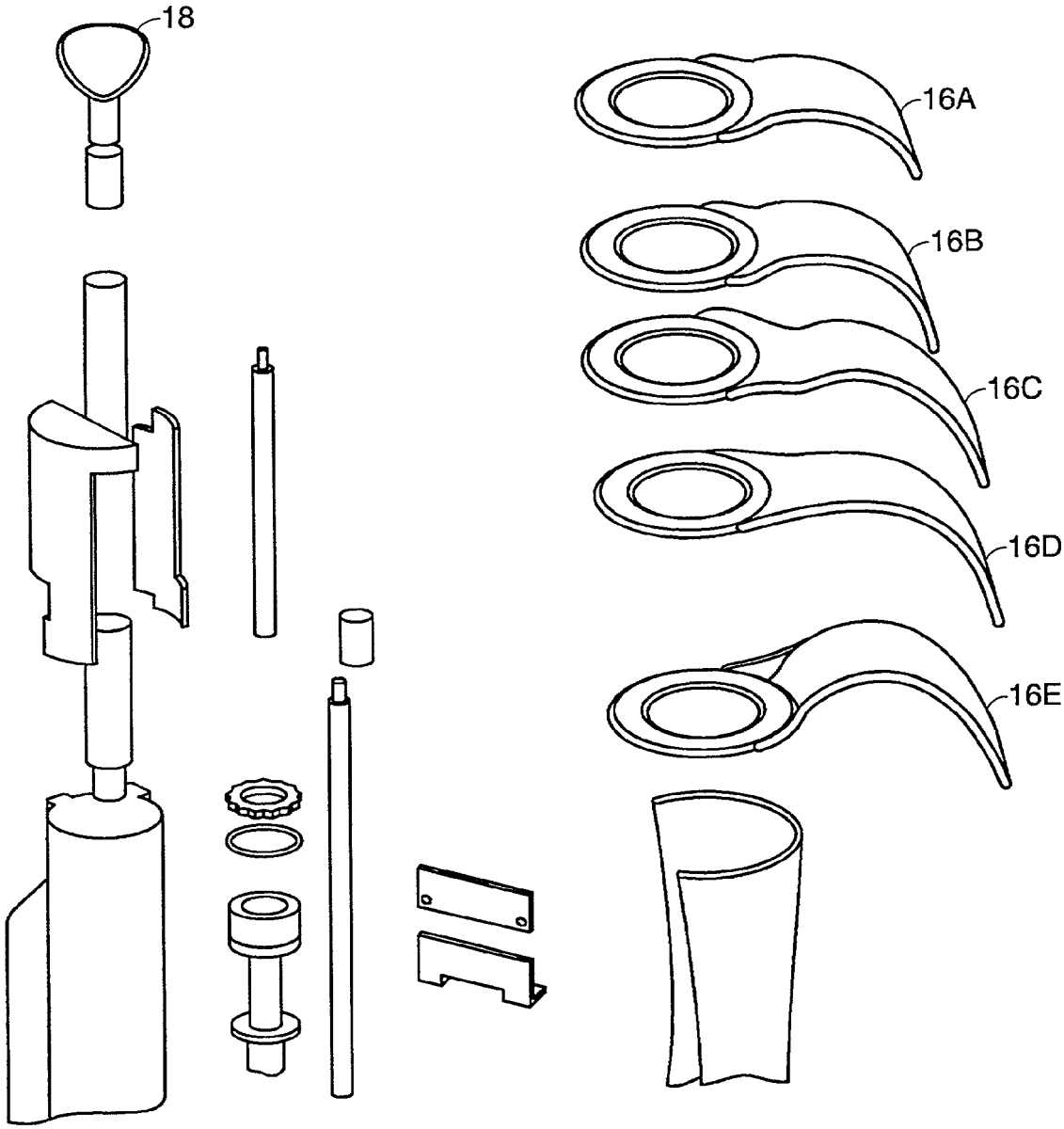
FIG. 4 is a partial exploded view of the pipette illustrating hooks of different size/shape which may be used when the pipette is assembled.
Figure 5A:
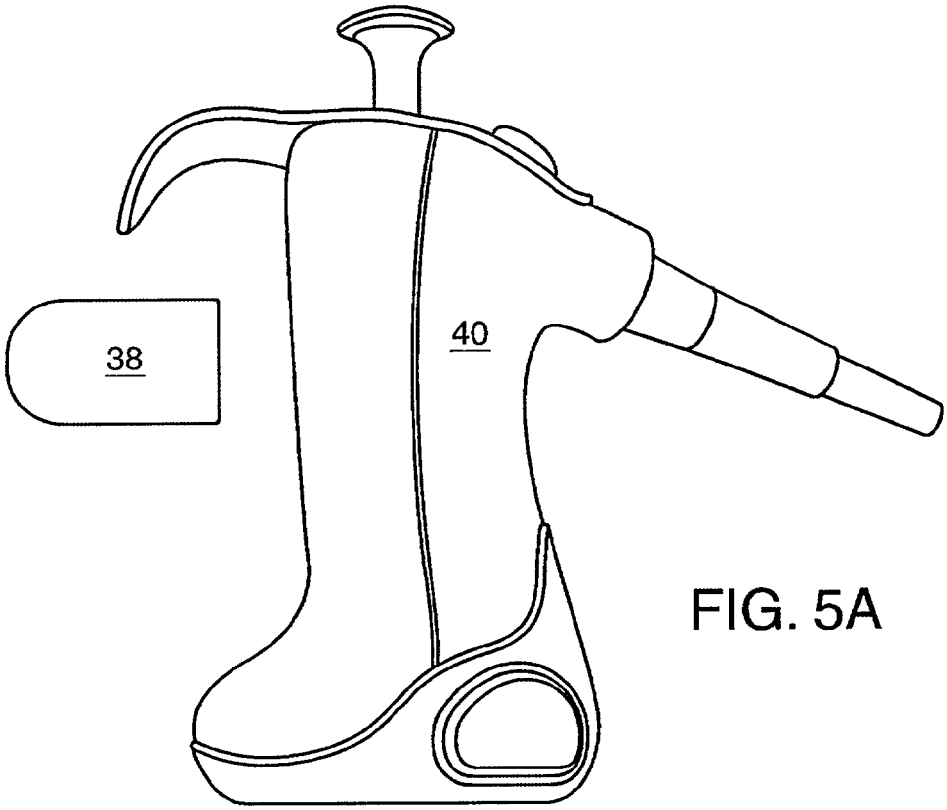
FIGS. 5A and 5B are photographs illustrating the use of adapters with the pipette.
Figure 5B:
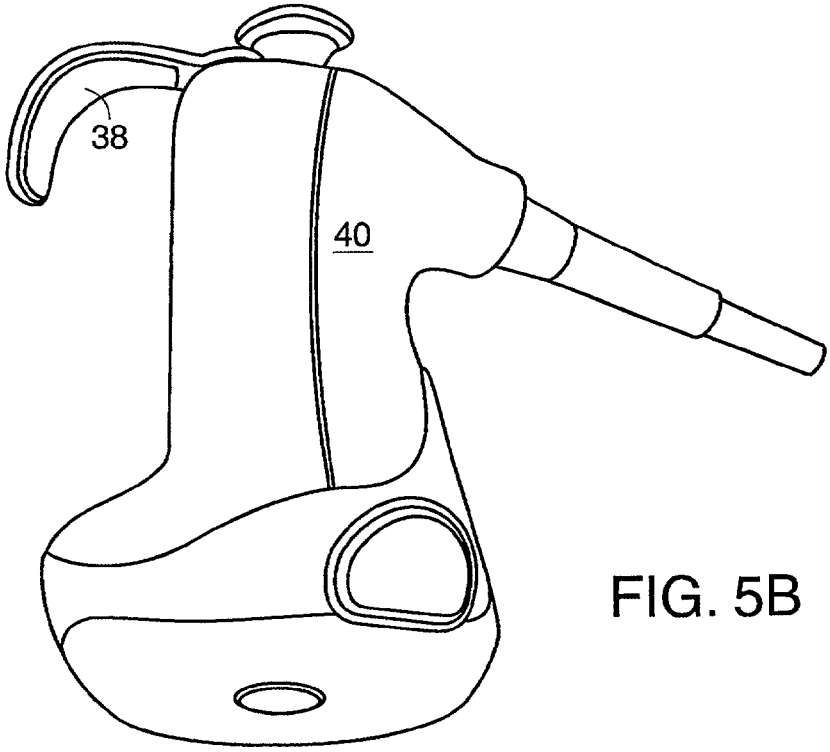

Hook 16 can also be made adjustable in a number of different ways to match the ergonomic requirements of the user. Thus, hook 16 can be mounted to be rotatable about the shaft of plunger 18 so that the circumferential angle ϕ of the hook to nozzle portion 14 may be adjusted for maximum comfort to the user (i.e. to rest, for example, squarely on the third joint of the user's index finger). The hook could also be mounted to slide up and down on body portion 12 and/or to have the angle of hook 16 relative to the axis of body portion 12 changed, again to optimize user comfort. Hook 16 can also be made as a snap on device, screw on device or otherwise replaceably secured to the pipette, so that alternative sizes and configurations could be installed to body 12 to match the needs of a user, FIG. 4 illustrating a plurality of different sized or shaped hooks 16A-16E, the most comfortable one of which is selected to be used on the pipette for a given user. Finally, an adapter 38 can be provided which attaches for example to the inside of the hook as shown in FIGS. 5A and 5B, the adapter used being selected to better fit the hook to the user's hand. All of these adjustments can facilitate the customization of the pipette to the ergonomic requirements of a particular user's hand size and shape and to accommodate various user preferences. In addition to the functions described so far, hook 16 also facilitates the holding and picking up of the pipette, opposes movement of plunger 18 and button 30 so that less gripping force is required when these elements are operated and could also be used to hang the pipette on a wall when not in use.

Finally, as shown in FIGS. 5A and 5B, an adapter 40 can be provided which fits over, or which is secured to, all or a portion of body portion 12 by snap, Velcro or other suitable connection mechanism to alter the thickness of the body portion, or at least selected parts thereof, to better fit the hand of a particular operator. A resilient material may also be mounted around all or selected parts of body 12, either as a sleeve over the body or attached at suitable places on the body, for example on the rear portion thereof adjacent to the users palm, in ways known in the art. Other techniques may also be employed to customize pipette 10 for the requirements of a particular user. The adapters, a sleeve on body 12, a coating on all or a selected portion of body 12 or the material for all or a selected portion of the body may also be of a sticky material, for example a thermoplastic rubber such as Santoprene™, to further aid in gripping and holding the pipette and reduce gripping forces required for use of the pipette.

The entire bottom section 34, or some selected portion thereof, may also be removable to provide access to the inside of body portion 12. This may be done to gain access for replacement of a battery used, for example, to operate a processor and display 22 and/or to control movement of a piston stop; to gain access to other components in the pipette for repair or other purposes; or so that working parts of the pipette can be sterilized by autoclaving or otherwise cleaned or sterilized.

While for the illustrative embodiment shown in the figures, plunger 18 extending from the top of body 12 is utilized to operate the aspiration/dispensing piston in body 12, this is by no means a limitation on the invention and the control for performing this function may be otherwise positioned. For example, a button could be positioned so as to be adjacent the operator's finger tips when the pipette is being properly held, the operator squeezing on the button with one or more fingers, preferably two or three fingers, to depress the piston. Other "power grip" configurations where operation of the piston occurs in response to a squeezing of all or a selected portion of body portion 12 are also within the contemplation of the invention. A forefinger operated "trigger" could also be suitably positioned on the body to operate the piston. For fully automatic operation, a button or switch could be substituted for plunger 18. Further, while a single nozzle is shown for the illustrative embodiment, a multiple nozzle head, with all nozzles being simultaneously operated from a single piston through suitable tubing, is also within the contemplation of the invention. Finally, while nozzle portion 14 extends from the top of body 12 for the embodiment shown, and this is currently the preferred configuration, so long as the angle for the nozzle is as indicated, the nozzle could extend from the side or even the bottom of the body, the nozzle for example having a double curve for such configurations so as to extend up toward the top of the body and then out from the body at the desired angle.

Thus, while the invention has been shown and described above with reference to a preferred embodiment, the foregoing and other changes in form and detail may be made therein by one skilled in the art while still remaining within the spirit and scope of the invention which is to be defined only by the appended claims.

What is claimed is:

1. A handheld pipette including:

a body portion having a vertical central axis longer than a horizontal central axis and shaped to fit in an operator's hand, wherein the body portion has a lowermost surface forming a base extending perpendicular or substantially perpendicular to the vertical central axis of the body portion and permitting the pipette to stand on a surface with the vertical central axis of the body portion perpendicular or substantially perpendicular to the surface;

a nozzle portion extending from a point on said body portion and at a downward angle θ of approximately 60° to 80° to the vertical central axis of said body portion;

a pipette tip mounted to an end of the nozzle portion in fluid communication with the nozzle portion, wherein at least the angle θ of said nozzle portion to the vertical central axis of said body portion and length of said pipette tip mounted to the end of said nozzle portion are selected such that said pipette tip does not touch the surface when the pipette is standing on the surface;

at least one button located on the top of the body portion and operable by a thumb of the operator to effect aspiration of liquid into the pipette tip mounted to the end of the nozzle portion and dispensing of the liquid from the pipette tip mounted to the end of the nozzle portion, the at least one button being further operable such that pressing of the at least one button by the thumb of the operator initiates the aspiration and the dispensing, the at least one button being aligned with or substantially aligned with the vertical central axis of the body portion; and wherein the base allows the tip to remain mounted to the nozzle portion when the pipette is standing on the surface and any liquid in the tip is prevented from moving back into the body portion because of the downward angle θ of the nozzle portion.

2. The handheld pipette as claimed in claim 1 where said angle θ is approximately 70° to said vertical central axis.

3. The handheld pipette as claimed in claim 1 wherein said angle θ is adjustable.

4. The handheld pipette as claimed in claim 1 wherein said angle θ is such as to permit at least one of the operator's wrist, elbow and shoulder to be in a substantially natural position when the pipette is performing a pipetting operation.

5. The handheld pipette as claimed in claim 1 wherein said angle θ is such that any tip mounting force is in a direction causing a major component of the force to be applied against and substantially perpendicular to a portion of the operator's hand grasping said body portion which is substantially between a second joint of the operator's fingers and a point slightly behind the operator's knuckles.

6. The handheld pipette as claimed in claim 1 including a hook extending from a point on said body portion which is sufficiently angularly spaced from the point from which said nozzle portion extends to permit the hook to fit over a selected portion of the operator's hand when the pipette is being held by the operator in a position of use.

7. The handheld pipette as claimed in claim 6 wherein said hook is adjustable to change at least one of an angle by which the hook is spaced from the nozzle portion, a height on the body portion for the point from which the hook extends and an angle of the hook relative to said vertical central axis.

8. The handheld pipette as claimed in claim 6 wherein said hook is removably mounted to said body portion, said hook being replaceable with a hook of different size/shape to accommodate at least one of user preference and different hand sizes.

9. The handheld pipette as claimed in claim 1 wherein said at least one button is operated in a direction at a selected angle to said nozzle portion.

10. The handheld pipette as claimed in claim 1 wherein said at least one button is shaped to minimize contact pressure on the operator's hand when the at least one button is operated.

11. The handheld pipette as claimed in claim 1 including a button on said body which controls ejection of the tip from said nozzle portion, said button being shaped to minimize contact pressure on the operator's hand when the button is operated.

12. The handheld pipette as claimed in claim 1 wherein a position of the nozzle portion and the angle θ are such that an end of the nozzle portion adjacent said body portion is closely adjacent the index finger of the operator when properly held.

13. The handheld pipette as claimed in claim 1 wherein said body portion has a bottom which is removable at least in part to provide access to the pipette.

14. The handheld pipette as claimed in claim 1 including an adapter selectively mountable to said body portion, said adapter adjusting the size of said body portion to better fit operator hand size.

15. The handheld pipette as claimed in claim 1 including padding on at least a portion of said body portion.

16. The handheld pipette as claimed in claim 1 wherein portions of said pipette which come in contact with the operator's hand are shaped to minimize contact pressure for the operator's hand during operation of the pipette.

17. The handheld pipette as claimed in claim 16 wherein the portions of said pipette which come in contact with the operator's hand are shaped so that the contact pressure at no point on said pipette exceeds 14 psi.

18. The handheld pipette as claimed in claim 1 wherein said nozzle portion extends from a point on an upper section of said body portion.

19. The handheld pipette as claimed in claim 1 wherein said body portion is shaped and said nozzle portion is positioned such that when the pipette is held in an operating position, the nozzle portion is at an angle substantially perpendicular to the operator's forearm.

20. A handheld pipette, comprising:

a body portion having a vertical central axis longer than a horizontal central axis and being shaped to fit in an operator's hand, the body portion including a lowermost surface forming a base extending perpendicular or substantially perpendicular to the vertical central axis of the body portion and permitting the pipette to stand on a surface with the vertical central axis of the body portion perpendicular or substantially perpendicular to the surface;

a nozzle portion extending from a point on an upper section of the body portion and at a downward angle θ within a range of approximately 60° to 80° with respect to the vertical central axis;

a pipette tip mounted to an end of the nozzle portion in fluid communication with the nozzle portion;

a button located on a top of the body portion and operable by a thumb of the operator to effect aspiration of liquid into the pipette tip mounted to the end of the nozzle portion and dispensing of the liquid from the pipette tip mounted to the end of the nozzle portion and to effect aspiration and dispensing of air through the nozzle portion, the button being further operable such that pressing of the button by the thumb of the operator initiates the aspiration and the dispensing, the button being aligned with or substantially aligned with the vertical central axis;

wherein the base allows the tip to remain mounted to the nozzle portion when the pipette is standing on the surface and any liquid in the tip is prevented from moving back into the body portion because of the downward angle θ of the nozzle portion; and a hook mounted to the body portion and extending from a point at an end or at substantially the end of the upper section of the body portion, the hook being angularly spaced by an angle ϕ from the point from which the nozzle portion extends, wherein at least the angle θ of the nozzle portion to the vertical central axis of said body portion and a length of the pipette tip mounted to the end of the nozzle portion are selected such that the tip does not touch the surface when the pipette is standing on the surface with the vertical central axis of the body portion perpendicular or substantially perpendicular to the surface.

21. The handheld pipette as claimed in claim 20, wherein the angle θ is adjustable.

22. The handheld pipette as claimed in claim 20, wherein the hook is adjustable to change at least one of the angle ϕ, a height on the body portion for the point from which the hook extends, and an angle of the hook relative to the vertical central axis.

* * * * *